US009251952B2

(12) United States Patent
Li et al.

(10) Patent No.: US 9,251,952 B2
(45) Date of Patent: Feb. 2, 2016

(54) METHOD FOR MANUFACTURING LAMINATED COIL DEVICES

(75) Inventors: Youyun Li, Shenzhen (CN); Dafu Lu, Shenzhen (CN); Yang Zhang, Shenzhen (CN); Cong Yuan, Shenzhen (CN)

(73) Assignee: ShenZhen Sunlord Electronics Co., Ltd., Shenzhen, Guangdong (CN)

( * ) Notice: Subject to any disclaimer, the term of this patent is extended or adjusted under 35 U.S.C. 154(b) by 141 days.

(21) Appl. No.: 13/978,542

(22) PCT Filed: Mar. 23, 2012

(86) PCT No.: PCT/CN2012/000366

§ 371 (c)(1),
(2), (4) Date: Jul. 7, 2013

(87) PCT Pub. No.: WO2013/134894

PCT Pub. Date: Sep. 19, 2013

(65) Prior Publication Data

US 2015/0020378 A1 Jan. 22, 2015

(30) Foreign Application Priority Data

Mar. 14, 2012 (CN) ..... 2012 1 0065423

(51) Int. Cl.
*H01F 7/06* (2006.01)
*H01F 41/04* (2006.01)
*H01F 17/00* (2006.01)

(52) U.S. Cl.
CPC ..... *H01F 41/04* (2013.01); *H01F 17/0013* (2013.01); *H01F 41/042* (2013.01)

(58) Field of Classification Search
USPC ..... 29/602.1, 604–607, 840; 336/65, 83, 336/84 M, 200, 232; 257/531
See application file for complete search history.

(56) References Cited

U.S. PATENT DOCUMENTS

| | | | | |
|---|---|---|---|---|
| 5,250,923 | A * | 10/1993 | Ushiro et al. | 336/83 |
| 6,194,248 | B1 * | 2/2001 | Amaya et al. | 438/110 |
| 6,238,779 | B1 * | 5/2001 | Iwao et al. | 428/210 |
| 6,429,763 | B1 * | 8/2002 | Patel et al. | 336/200 |
| 6,504,466 | B1 * | 1/2003 | Katsurada | 336/200 |
| 6,544,365 | B2 * | 4/2003 | Tokuda et al. | 156/89.12 |
| 6,593,841 | B1 * | 7/2003 | Mizoguchi et al. | 336/200 |
| 7,323,948 | B2 * | 1/2008 | Ding et al. | 331/181 |
| 2002/0008606 | A1 * | 1/2002 | Okuyama et al. | 336/200 |
| 2002/0067236 | A1 * | 6/2002 | Andoh et al. | 336/200 |
| 2002/0125547 | A1 * | 9/2002 | Kawase et al. | 257/531 |
| 2002/0140539 | A1 * | 10/2002 | Takashima et al. | 336/200 |
| 2002/0144765 | A1 * | 10/2002 | Tatsukawa et al. | 156/89.12 |

* cited by examiner

*Primary Examiner* — Paul D Kim
(74) *Attorney, Agent, or Firm* — Raymond Y. Chan; David and Raymond Patent Firm

(57) ABSTRACT

A method of manufacturing a laminated coil device includes conductors for forming coils and insulation stacking for forming laminated bodies, and further includes the steps of: (A) manufacturing ceramic insulating thin sheets; (B) forming ceramic insulating thin sheets with conductive through-holes; (C) manufacturing coil thin sheets with coil conductors so as to embed the coil conductors inside the ceramic insulating thin sheets; (D) orderly stacking and cutting ceramic insulating thin sheets and coil thin sheets with coil conductors into unit sizes in order to obtain laminated bodies; (E) heating the laminated bodies in order to remove the binder, and then sintering the laminated bodies; (F) coating the conductive paste on the two ends of the laminated bodies so as to form external electrodes. Thus, the present invention is to provide a manufacturing method of producing a laminated coil power device with low direct current resistance, no delamination, no air space, and no lamination cracking.

7 Claims, 2 Drawing Sheets

METHOD FOR MANUFACTURING LAMINATED COIL DEVICES

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a method of manufacturing a laminated coil device.

2. Description of Related Arts

A laminated coil power device can be one of laminated large-current ferrite chip beads, a laminated power inductor, and a laminated power transformer. Laminated coil devices are widely applied to the power cable of many kinds of portable products because it has the advantages of high reliability, may be mass produced, and is easily miniaturized and thinned.

Particularly, when the laminated coil power device uses ceramic materials, it is desirable to reach large impedance and inductance values while maintaining a small size and thinness of the end product, and in particular to have ultra-low DC resistance within the laminated coil power device so as to support a large current. Therefore, the laminated coil power device with a narrow and thick cross-section of the coil electrodes has been developed in order to reach the purposes mentioned above.

FIGS. 1 and 2 show the traditional laminated coil device comprising a ceramic insulating layer 202 with an electrode 201 directly printed thereon. In the traditional method, after the electrode paste is printed on the insulating layer 202, the electrode paste inevitably spreads out in a manner that makes it difficult to form a narrow and thick electrode. Because the area around the coils is minimal there is reduced impedance and inductance value of the end products. And as shown in FIG. 3, the traditional laminated coil device utilizes a multiple printing method to increase the thickness of the electrode 201, wherein when a plurality of thin sheets are stacked, the electrode printed on the surface of the insulating layer is raised. Thus the traditional laminated coil device may be characterized by a mismatch of the ceramic insulating layers 202 involving air spaces 203, which may short circuit the electrode, and result in lamination cracking, and delamination.

To solve the problems of the traditional laminated coil device, China Patent No. CN201138593Y discloses a product providing a plurality of coils connected in parallel, isolated with each other so as to reduce the resistance of the direct current of the ferrite chip beads. However, although the parallely-connected coils are able to reduce the impedance and inductance value of the product, the multiple parallely-connected coils exponentially increase the cost of the products, and have the limitation of a reduction of thickness.

Furthermore, Japanese Patent No. 11-97244 discloses a method of providing a plurality of coils connected in parallel and then integrated into a spiral-shaped coil so as to reduce the resistance of the direct current. Although this, on one hand, dramatically increases the length of the magnetic path and decreases the impedance and inductance value of the products, on the other hand, this method is high in cost, and has the limitation of thinning.

SUMMARY OF THE PRESENT INVENTION

A main object of the present invention is to provide a method of manufacture that produces a laminated coil power device with low thickness and low direct current resistance.

Accordingly, in order to accomplish the above object, a method of manufacturing a laminated coil device comprises the steps of:

(A) manufacturing ceramic insulating thin sheets;

(B) forming parts of ceramic insulating thin sheets with conductive through-holes;

(C) manufacturing coil thin sheets having coil conductors so as to embed the coil conductors inside the ceramic insulating thin sheets:

(D) orderly stacking and cutting ceramic insulating thin sheets and coil thin sheets with coil conductors into unit sizes in order to obtain laminated bodies.

As specified above, the following two methods can be applied to perform the above step (C).

Method 1:

(C101) Ceramic paste is printed on the ceramic insulating thin sheets having conductive through-holes obtained from step (B) by a screen printing method so as to form a main part of the coil thin sheets. Thus, the predetermined positions for the coils are not printed with ceramic paste thereby forming coil-shaped trenches;

(C102) By the screen printing method, the conductive paste primarily including of silver is printed into the coil-shaped trenches, and the thickness of the conductive paste is either equal or slightly larger than the depth of the coil-shaped trenches, thereby forming internal electrodes.

Method 2:

(C201) By the laser etching method, coil shaped trenches are formed at the predetermined positions on the ceramic insulating thin sheets obtained from step (A).

(C202) After the ceramic insulating thin sheets having coil shaped trenches obtained from (C201) and the ceramic insulating thin sheets with conductive through-holes obtained from step (B) are stacked together, the conductive paste primarily including silver is printed into the coil shaped trenches by the screen printing method. Thus, the thickness of the conductive paste is either equal or slightly larger than the depth of the coil shaped trenches, so as to form internal electrodes.

According to the above mentioned method of the present invention, because the coil conductors will not spread, and thereby the width of the electrode is controlled. Furthermore, there is unlikely a reduction of the area surrounding the coils causing a decrease of impedance and inductance value. On the other hand, the electrode does not project and interfere with the connection between layers, eliminating the possibility of an air space that might result in short circuit of the electrode, lamination cracking, and delamination for the present invention.

Generally speaking, according to the method of the present invention, it provides a convenient, low cost method of manufacturing narrow and thick coil electrodes, but also provides the ability for small, thin low cost manufacture of laminated coil power device with large impedance and inductance value, low DC resistance, low in cost, small in size, and low thickness.

DETAILED DESCRIPTION OF THE PREFERRED EMBODIMENT

Below will illustrate the preferred embodiment of the present invention.

A method of manufacturing a laminated coil device comprises the steps of:

(A) manufacturing ceramic insulating thin sheets;

(B) forming parts of ceramic insulating thin sheets to ceramic insulating thin sheets with conductive through-holes;

(C) manufacturing coil thin sheets having coil conductors so as to embed the coil conductors inside the ceramic insulating thin sheets;

(D) orderly stacking and cutting ceramic insulating thin sheets and coil thin sheets with coil conductors into unit sizes in order to obtain laminated bodies.

(E) heating the laminated bodies at the temperature of 400 degrees centigrade for 2 hours so as to remove the binder, and then sintering the laminated bodies at the temperature of 850~910 degrees centigrade for 2~6 hours.

(F) coating the conductive paste primarily comprised of silver, on the two ends of the laminated bodies by the impregnation method, and then sintering the laminated bodies with silver coated at the temperature of 600 degrees centigrade for 1 hour so as to form external electrodes.

Figure 1:
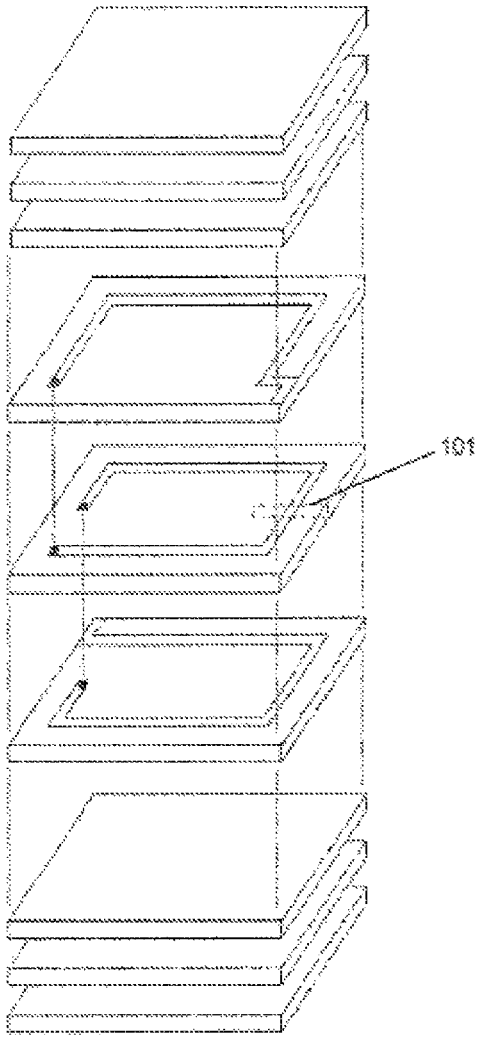
Fig. 1 Prior Art
FIG. 1 is a schematic view of the laminated layers of the laminated coil device.
Figure 2:
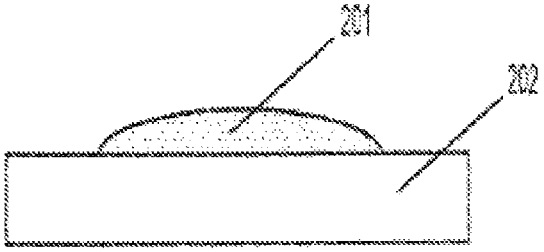
Fig. 2 Prior Art
FIG. 2 is a schematic cross-sectional view of 101 of FIG. 1, and illustrates the cross-section view of the electrodes processed by the direct printing method.
Figure 3:
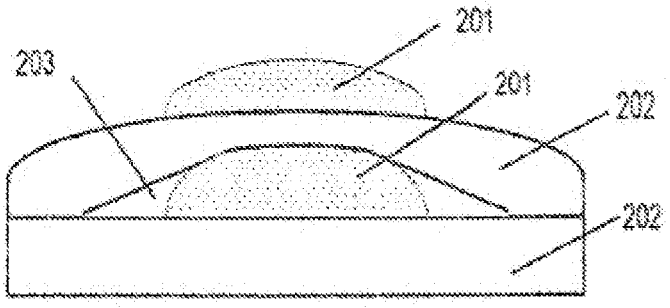
Fig. 3 Prior Art
FIG. 3 illustrates a schematic cross-sectional view of the electrodes of two laminated coil thin sheets obtained from the direct printing method.
Figure 4:
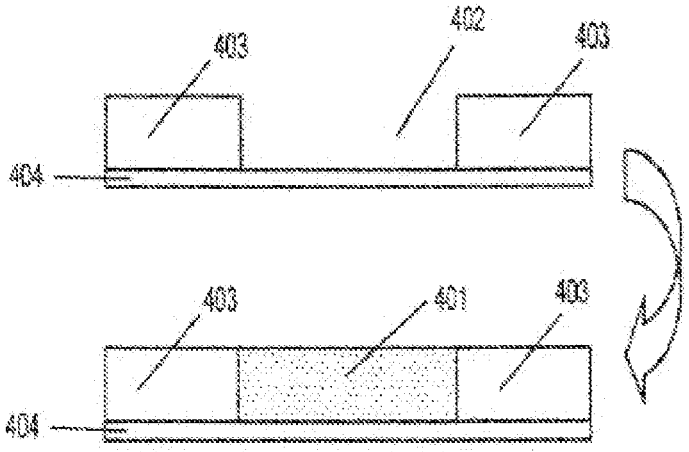
FIG. 4 is a cross-section view of the electrodes of coil thin sheets according to a preferred embodiment of the present invention.

As shown in FIG. 4, according to the preferred embodiment of the present invention the coil conductor is embedded inside the inner of the ceramic sheets and not directly printed on the surface of the ceramic thin sheets. In other words, the coil-shaped trenches are formed on the ceramic thin sheets, and then the coil conductor paste is filled into the coil-shaped trenches by the screen printing method.

As specified above, the following two methods can be applied to perform the above step (C).

Method 1:

(C101) The ceramic paste is printed on the ceramic insulating thin sheets having conductive through-holes obtained from step (B) by a screen printing method so as to form a main part of the coil thin sheets. Thus, the predetermined positions for the coil thin sheets have no ceramic paste printed so as to form coil-shaped trenches;

(C102) By the screen printing method, the conductive paste primarily comprised of silver is printed into the coil-shaped trenches, and the thickness of the conductive paste is either equal or slightly larger than the depth of the coil-shaped trenches, so as to faun internal electrodes.

Method 2:

(C201) By the laser etching method, the coil shaped trenched is formed at the predetermined positions of the ceramic insulating thin sheets obtained from step (A).

(C202) After the ceramic insulating thin sheets having coil shaped trenches obtained from (C201) and the ceramic insulating thin sheets with conductive through-holes obtained from step (B) are stacked together, the conductive paste primarily comprised of silver is printed into the coil shaped trenches by the screen printing method. Thus, the thickness of the conductive paste is either equal or slightly larger than the depth of the coil shaped trenches, so as to form internal electrodes.

A method of manufacture for a laminated power inductor is an exemplary embodiment described below. The laminated power inductor is made of ceramic materials that are ferrites, wherein the compositions of the ferrites are applied for the method of manufacture of the laminated power inductor of present industrial and so on. The following briefly describes the method of manufacture for a laminated power inductor. First, the predetermined amount of the powder of $Fe_2O_3$, Cuo, ZnO, and NiO are weighed to process wet mixing in a ball mill machine, then the wet-mixed powder of $Fe_2O_3$, Cuo, ZnO, and NiO are dried and followed by calcining at the calcination temperature of 700-1300 C so as to obtain the ferrite materials. Subsequently, trace of $Bi_2O_3$ and $CO_2O_3$ adopted for decreasing the calcination temperature and adjusting materials' properties are added to the ferrite materials. Finally, the ferrite materials are crushed into predetermined sizes in a sand mill so as to obtain the ultra-fine powdered ferrites.

The method of manufacture for ferrite paste is based on the above mentioned manufacture method of ultra-fine powdered ferrites. The method for manufacture for ferrite paste is the same as the method for manufacture the laminated coil power inductor. Organic solvents, such as ethyl acetate, ethanol, isopropyl alcohol, and terpineol, and the organic binder, such as polyvinyl-butyral, ethyl cellulose, and acrylic resin, are added into the ultra-fine powdered ferrites as mentioned above, and furthermore the plasticizer and dispersant are also able to add into the ultra-fine powdered ferrites as needed. So that, after mixing all mentioned solvents, binders, plasticizers and dispersants as needed, the ferrite paste is obtained.

The ferrite paste as mentioned above enables the manufacture of thin sheets having the thickness of 10-60 um, and that may be cut into predetermined sizes so as to obtain the ferrite insulating thin sheets. The ferrite insulating thin sheets with the thickness of 10-40 um, such as 25 um, are drilled to form through holes at the predetermined position with the diameter of 50-200 um, such as 150 um, by the laser drilling method so as to manufacture ferrites insulating thin sheets with conductive through holes.

According to the first preferred embodiment of the present invention, the coil thin sheet with coil conductors is manufactured by following the method 2. As shown in FIG. 4, the ferrite insulating coil thin sheets 403 with the thickness of 20-60 um, such as 50 um, are etched to have predetermined coil-shaped trenches 402 by the laser etching method. Obviously, the depths of the coil-shaped trenches 402 are equal to the thickness of the insulating coil thin sheets 403. The thickness of the insulating coil thin sheet of the first preferred embodiment of the present invention is 50 um. Moreover, the insulating coil thin sheets 403 having coil shaped trenches and the insulating thin sheets 404 with conductive through-holes are stacked together, and then the conductive paste comprised substantially of silver is printed into the coil shaped trenches 402 so as to form coil electrodes 401. In addition, the thickness of the conductive paste fillers are either equal or slightly larger than the depth of the coil shaped trenches, and the altitude between the thickness of the conductive paste and the depth of the coil shaped trenches can't exceed 5 um. In the first preferred embodiment of the present invention, the thickness of the fillers defined as 50 um is equal to the depth of the coil shaped trenches. Depending on the existence of through holes, the conductive paste is also able to fill into the through holes in order to reach the connection between each of the coil conductors after stacking. It is worth mentioning that the lowermost coil layer does not need to be stacked with an insulating thin sheet having conductive through holes, but rather with an insulating thin sheets without conductive through holes. Finally, the ferrite insulating thin sheets and coil thin sheets are to be orderly stacked and cut into unit sizes in order to obtain laminated bodies.

Figure 5:
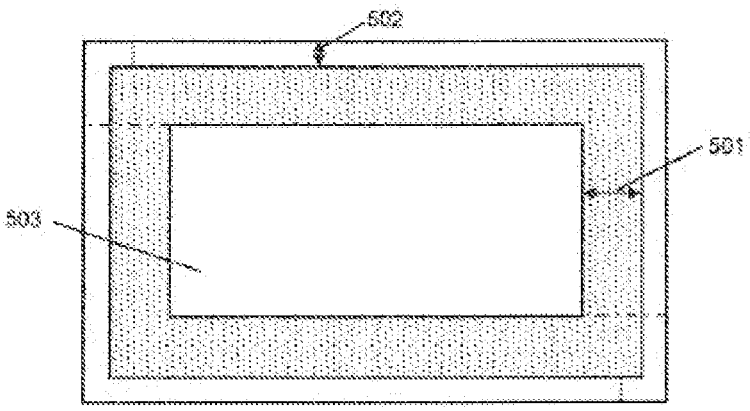
FIG. 5 is the top perspective view of laminated bodies before sintering according to the preferred embodiment of the present invention.

In general, in order to obtain the laminated coil device having large impedance, large inductance value, and low direct current resistance, the design of the electrode coil has to meet explicit requirements. FIG. 5 shows the top perspective view of the laminated bodies, and the ratio of the thickness and width of the electrode fillers must be larger than 20%. According to the first embodiment, the width of the electrode 501 is designed as 235 um, and that is the ratio of the thickness and width of the electrode is 21.3%. Before sintering, the distance between the outer margin of the electrode and the outer margin of the laminated bodies 502 must be less than 120 um. In the first preferred embodiment, the distance between the outer margin of the electrode and the outer margin of the laminated bodies 502 is 100 um. In other words, before sintering, an area 503 surrounding by the coil is up to 30% percentage of the surface area of the laminated bodies.

The laminated bodies are heated at the temperature of 400 degrees centigrade for 2 hours so as to remove the binder, and then the laminated bodies are sintered at the temperature of 850~910 degrees centigrade for 2~6 hours so as to obtain sintered laminated bodies.

Finally, the two ends of the sintered laminated bodies are coated with conductive paste primarily including silver by the impregnation method, and then are sintered at the temperature of 600 degrees centigrade for 1 hour so as to form external electrodes. Based on the specific requirement, the nickel layer and tin layer are able to electroplate on the external electrodes. At this point, the production of the laminated coil power inductor of the first preferred embodiment of the present invention is completed.

According to the second embodiment, since the method 1 as mentioned before are used in manufacturing the coil thin sheets having coil conductors, the rest of the steps for manufacturing the laminated coil power device are the same as the first embodiment.

As shown in FIG. 4, the ferrite paste is printed and dried on the insulating thin sheets 404 having conductive through-holes by a screen printing method, wherein the ferrite paste is printed on the margin of the predetermined positions for coils conductors so as to form a main part of the coil thin sheets 403, but the predetermined positions for the coils conductors have no ferrites paste printed so as to form coil-shaped trenches 402.

After drying, the depth of the trenches is equal to the thickness of the main part of the coil thin sheets 403. In the second embodiment, the depth of the trenches 402 defined as 50 um is equal to the thickness of the main part of the coil thin sheets 403. By the screen printing method, the conductive paste primarily including silver is printed into the coil-shaped trenches 402 so as to form coil electrode 401. The thickness of the conductive paste is either equal or slightly larger than the depth of the coil-shaped trenches 402. In the second preferred embodiment of the present invention, the thickness of the fillers defined as 50 um is equal to the depth of the coil-shaped trenches 402. Depending on the existing of through holes, the conductive paste is also able to fill into the through holes in order to reach the connection between each coil conductors after stacking. It is worth mentioning that the lowermost main part of the coil thin sheets 403 and electrode 401 do not need to be printed on the insulating thin sheet having conductive through holes, but need to be printed on the insulating thin sheets without conductive through holes.

For the second embodiment, the requirements for the design of the electrode coil are the same as the first embodiment.

According to such laminated coil power inductor as mentioned above, when the conductive paste is filled into coiled shaped trenches, on one hand, the conductive paste is unable to spread and cause the reduction of the thickness of the electrode and the widening of the width of the electrode. Therefore in the present invention, since the electrode is not projected to affect the connection between layers, it does not result in air spaces that may cause the short circuit of electrodes, lamination cracking, and/or delamination.

As specific above, the laminated coil power inductor is an exemplary embodiment for illustrating the preferred embodiment of the present invention. However, the preferred embodiment of the present invention can also be one of the laminated large-current chip beads, laminated inductors with multiple rows of coils, a laminated power transformer, laminated common mode choke coils, laminated LC composite parts having capacitances inside the laminated bodies, and laminated fillers.

One skilled in the art will understand that the embodiment of the present invention as shown in the drawings and described above is exemplary only and not intended to be limiting. Therefore, this invention includes all modifications encompassed within the spirit and scope of the following claims.

What is claimed is:

1. A method of manufacturing a laminated coil device comprising the steps of:

(A) manufacturing ceramic insulating thin sheets;

(B) forming parts of the ceramic insulating thin sheets to have conductive through-holes;

(C) manufacturing coil thin sheets having coil conductors so as to stack the coil conductors with said ceramic insulating thin sheets;

(D) orderly stacking and cutting said ceramic insulating thin sheets so that said coil thin sheets having coil conductors are cut into unit sizes in order to obtain laminated bodies;

(E) heating the laminated bodies at the temperature of 400 degrees centigrade for 2 hours so as to remove a binder, and the sintering the laminated bodies at the temperature of 850~910 degrees centigrade for 2~6 hours; and (F) coating the conductive pastes primarily consisting of silver on two ends of the laminated bodies by the impregnation method, and then sintering the laminated bodies with silver coated at the temperature of 600 degrees centigrade for 1 hour so as to form external electrodes.

2. The method of manufacturing a laminated coil device, as recited in claim 1, wherein the step (C) comprises the steps of:

(C101) printing ceramic pastes on said ceramic insulating thin sheets having said conductive through-holes obtained from step (B) by a screen printing method so as to form a body of said coil thin sheets, wherein there are predetermined positions for said coil thin sheets with no ceramic pastes printed so as to form coil-shaped trenches; and (C102) printing conductive paste primarily consisting of silver into said coil-shaped trenches by the screen printing method, a thickness of the conductive paste being either equal or slightly larger than a depth of said coil-shaped trenches so as to form internal electrodes.

3. The method of manufacturing a laminated coil device, as recited in claim 2, wherein a ratio of the thickness and width of said coil-shaped trenches is larger than 20%.

4. The method of manufacturing a laminated coil device, as recited in claim 2, wherein, before sintering, a distance between an outer edge of the internal electrodes and an outer margin of the laminated bodies must be less than 120 um.

5. The method of manufacturing a laminated coil device, as recited in claim 2, wherein, before sintering, an area surrounding by the coil conductors is up to 30% percent of a surface area of the laminated bodies.

6. The method of manufacturing a laminated coil device, as recited in claim 1, wherein a thickness of said ceramic insulating thin sheets are 10-60 um.

7. The method of manufacturing a laminated coil device, as recited in claim 1, wherein a diameter of said conductive through holes of said ceramic insulating thin sheets is 50-200 um.

* * * * *